US007534164B1

(12) United States Patent
Lo

(10) Patent No.: US 7,534,164 B1
(45) Date of Patent: May 19, 2009

(54) TRANSMISSION STRUCTURE OF THE STONE CHAMFERING MACHINE TOOL HOLDER

(76) Inventor: Kung-Cheng Lo, No. 15-3, Linsen West Road, Changhua City (TW)

( * ) Notice: Subject to any disclaimer, the term of this patent is extended or adjusted under 35 U.S.C. 154(b) by 2 days.

(21) Appl. No.: 11/950,379

(22) Filed: Dec. 4, 2007

(51) Int. Cl.
*B24B 9/00* (2006.01)

(52) U.S. Cl. ..... 451/247; 451/44; 125/5

(58) Field of Classification Search ..... 451/247, 451/43, 44, 359, 363, 362, 57, 58; 125/5
See application file for complete search history.

(56) References Cited

U.S. PATENT DOCUMENTS 2,670,636 A * 3/1954 Burg ..... 408/132
4,922,595 A * 5/1990 Hattori et al. ..... 29/40
5,718,621 A * 2/1998 Turley ..... 451/342
6,390,900 B1 * 5/2002 Susnjara ..... 451/178
7,128,641 B1 * 10/2006 Lin ..... 451/359

* cited by examiner

*Primary Examiner*—Robert Rose
(74) *Attorney, Agent, or Firm*—Rabin & Berdo, P.C.

(57) ABSTRACT

A tool holder transmission structure of a stone chamfering machine which is mainly characterized in that a transmission motor is installed at downward offset position inside the frame of the stone chamfering machine, whereof the transmission gear installed on the spindle of the said motor is through the bottom cut slot of the centered convex block at side plate of the frame to engage with the bottom tool driven gear of the multi-axis tool holder, whereby through rotation of the tool holder, different tool driven gear can be changed to engage with the motor transmission gear. Therefore, it is particularly useful to select different tools for stone chamfering operation according to practical needs.

3 Claims, 6 Drawing Sheets

TRANSMISSION STRUCTURE OF THE STONE CHAMFERING MACHINE TOOL HOLDER

BACKGROUND OF THE INVENTION (a) Field of the Invention

The invention is related to a tool holder transmission structure of a stone chamfering machine which is mainly characterized in that a tool holder which can be operated to rotate is installed on a convex block of a side plate which is located at one end of the stone chamfering machine, whereby the tool holder can be positioned by an elastic lockpin which is preset on one side of the side plate. Further, the tool holder and the frame can be completely matched when pushed by the compacting plate handle whereby the bottom driven gear of the multi-axis tool installed on the tool holder can be engaged with the transmission gear of the motor inside the Frame. Therefore, it is particularly useful to select different tools for stone chamfering operation according to practical needs, thereof to improve the inconveniences and disadvantages of changing tools in the conventional one-tool type machines.

(b) Description of the Prior Art

Generally, for overall appearance and to avoid accidents from sharpened edges of cut stones, the stone edges are usually chamfered to provide a nicer outlook and a better safety.

Most of the stone edge chamfering work is done by using a special purpose stone chamfering machine, whereby through reciprocating the stone chamfering machine and the transmission of inside installed motor to grind the tool to achieve the chamfering function.

Whereas, the structure design of the conventional stone chamfering machine is usually of the embodiment of "one tool-one motor" to achieve stone edges chamfering function. Under this embodiment, in case there are different specifications of stones or operation requirements for different grinding roughness, the tool replacement is necessary. The original tool is dismounted and replaced with a suitable tool, and then if there is a different operation requirement, the tool replacement will have to be repeated again. As such, it causes a lot of man hours loss and inconveniencies while several sets of tools must also be prepared at the same time, and each tool need to be saved in special purpose storage boxes for easy carry that is also troublesome and inconvenient. Especially, if the tool is not saved in the storage box after replacement directly, it is easy to have a tool lost problem that may result in the case when a tool of particular specification is needed but cannot be found, and consequently the operation is seriously affected and an additional cost of re-purchase is generated, therefore this situation is hardly ideal and improvements are necessary.

SUMMARY OF THE INVENTION

Regarding the numerous problems and disadvantages of the conventional one-tool stone chamfering machine application, the inventor based on his many years of experience and skills in the related business has researched and developed the tool holder transmission structure of the invention, whereof it is mainly purposed to equip the stone chamfering machine with multiple tools of different specifications through the combination of structure designs thereby to provide a linkage transmission function which allows a suitable tool to be fetched corresponding to different operation requirements through a proper selection and change process.

Another purpose of the invention is to provide a simple operation for the tool change operation on the stone chamfering machine and to obtain an ideal transmission linkage function through the assembly design of structure, i.e. the main purpose of the invention is through the multi-axis tool holder design to achieve quick and simple tool change corresponding to different operation requirements while avoids troubles and inconveniencies in repeatedly mounting/dismounting tools in the conventional structures and avoids the needs to carry or reserve the tool storage boxes. Further the tool lost problem is less likely to happen. Therefore, it is particularly capable to provide good application and usefulness to the industry.

DETAILED DESCRIPTION OF THE PREFERRED EMBODIMENTS

Figure 1:
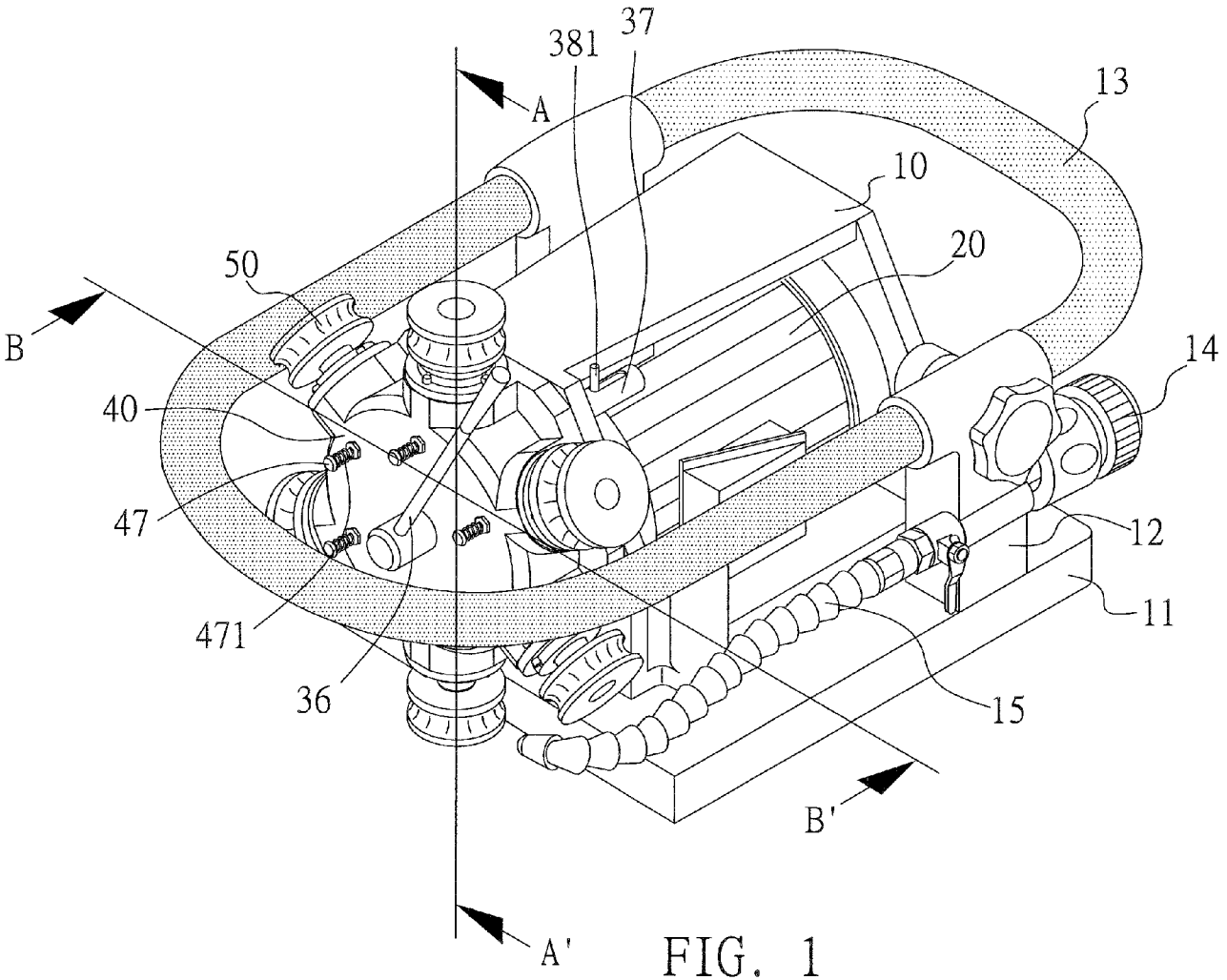
FIG. 1 is a structural schematic drawing of a preferred embodiment of the invention.
Figure 2:
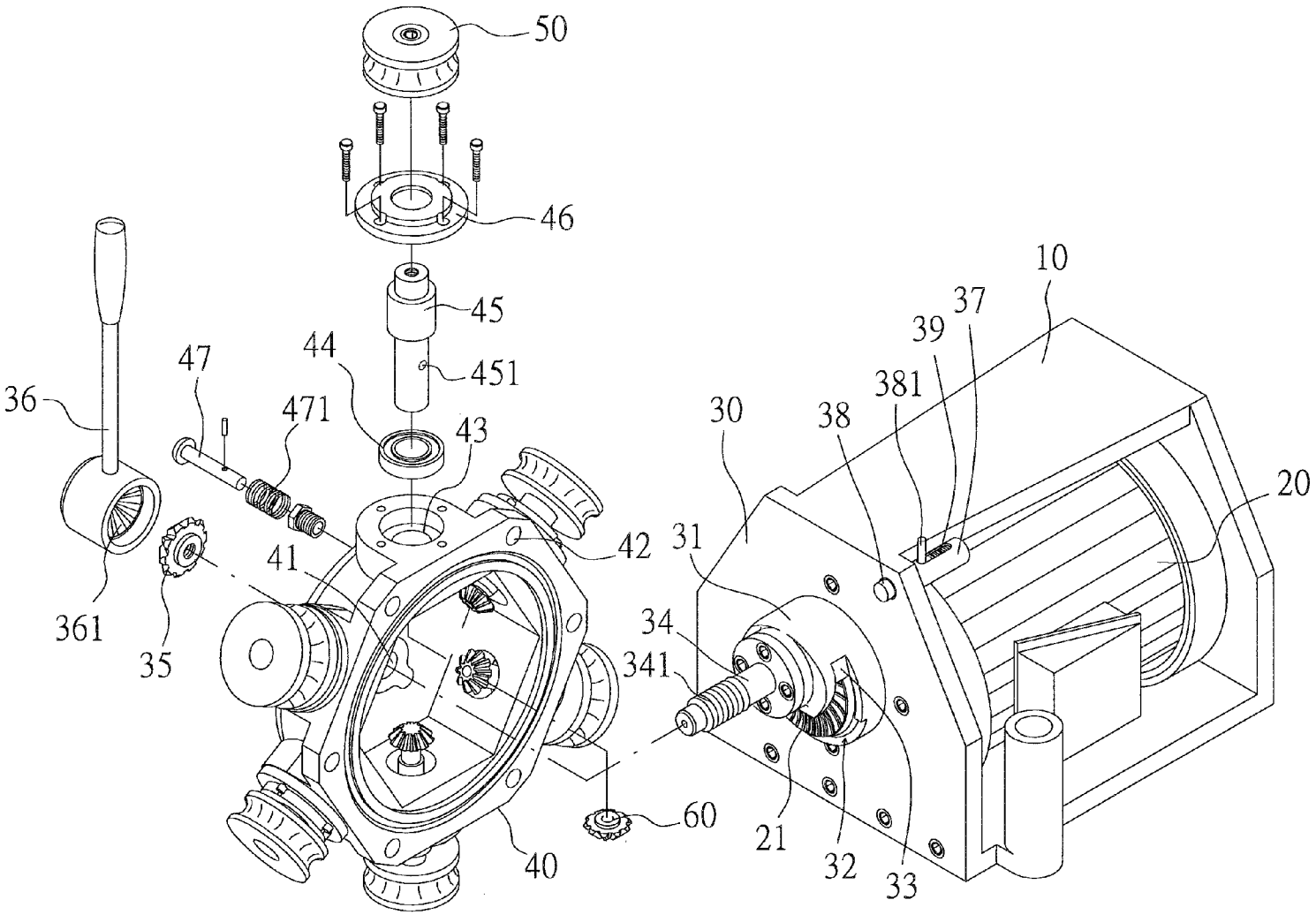
FIG. 2 is a partial explosion of structure explosion view of a preferred embodiment of the invention.
Figure 3:
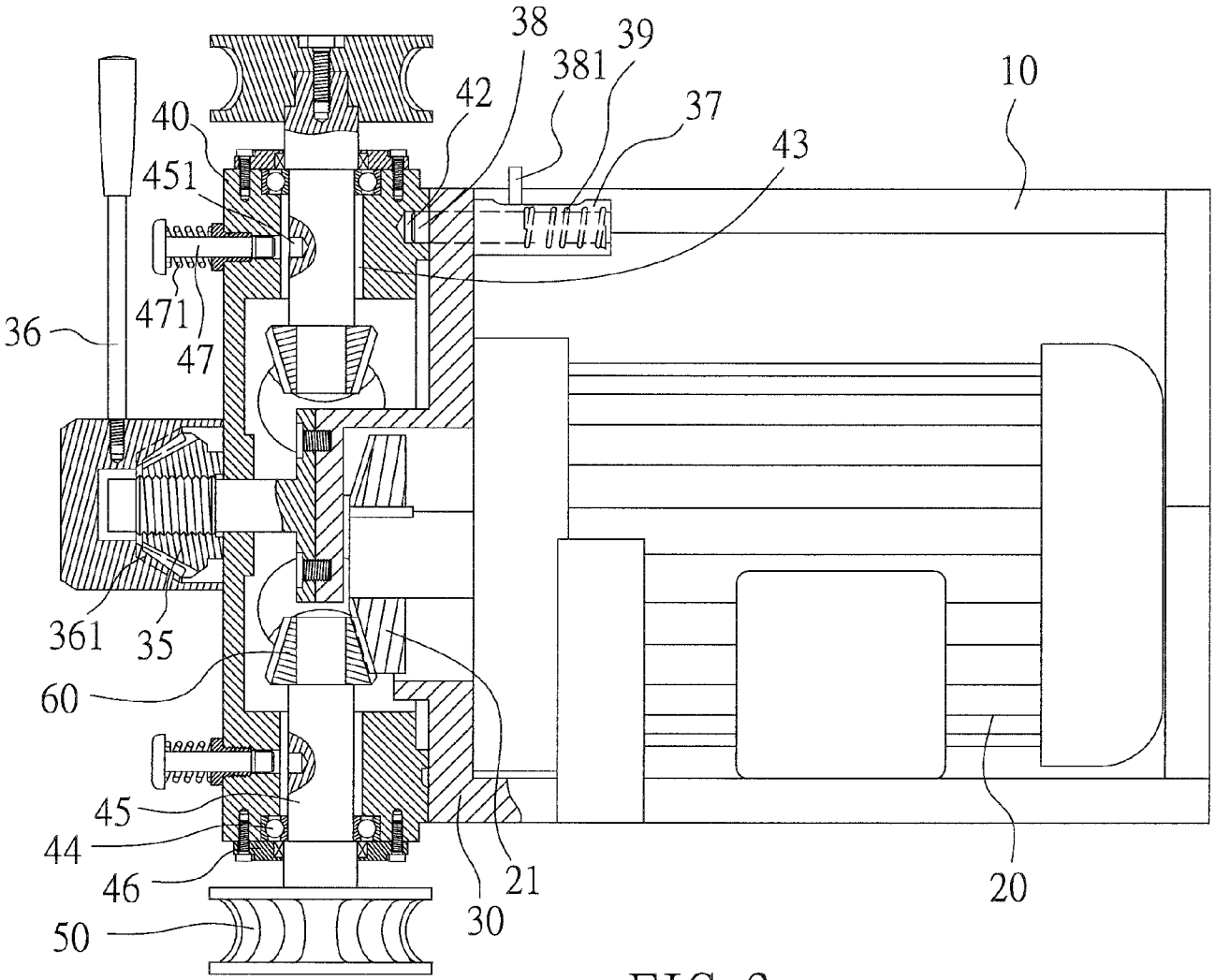
FIG. 3 is a preferred embodiment of the invention illustrating the structure relation in A-A' section schematic view.
Figure 4:
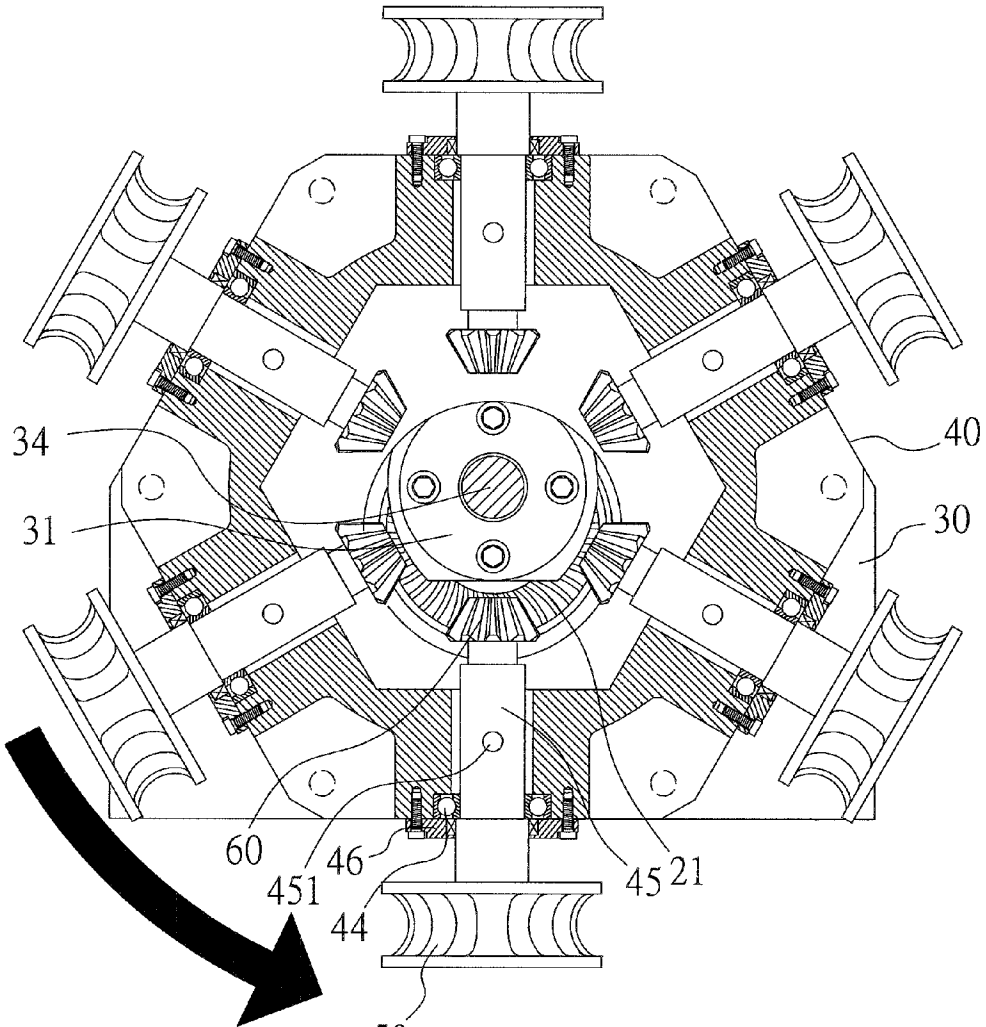
FIG. 4 is a preferred embodiment of the invention showing the structural relation in the B-B' section schematic view.
Figure 5:
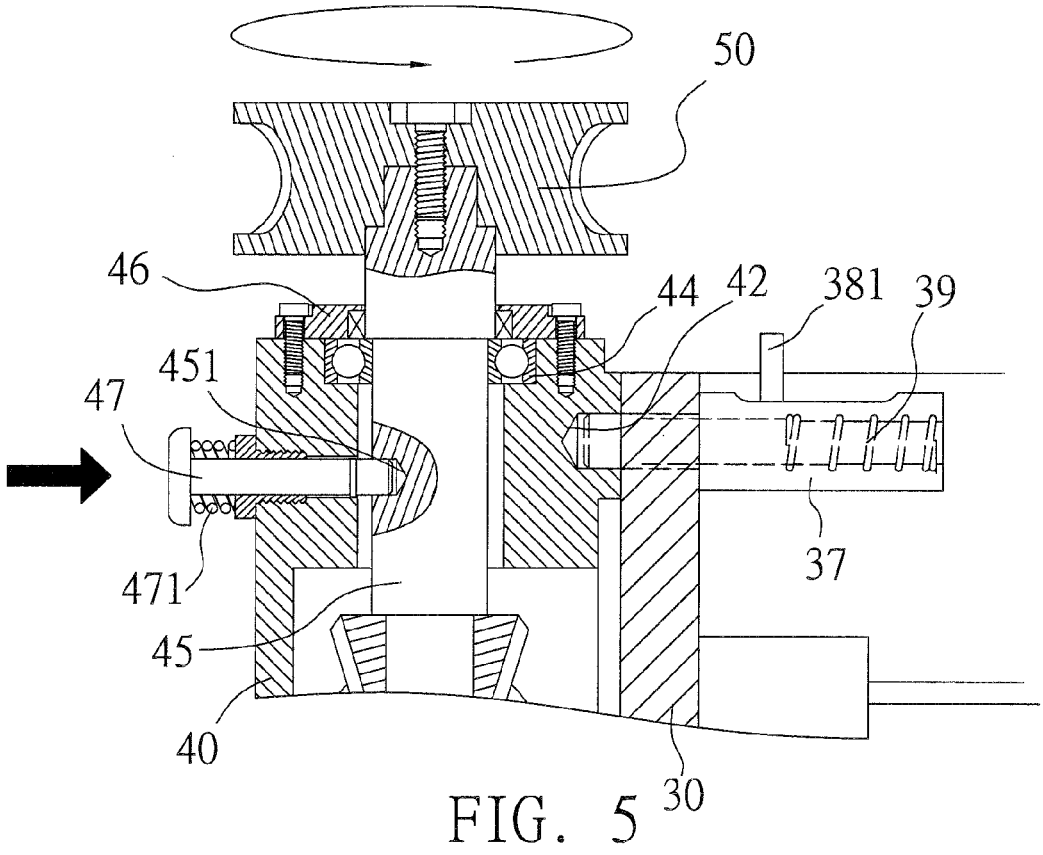
FIG. 5 is a schematic drawing of a preferred embodiment of the invention illustrating the structure relation between the positioning pin and the spindle in positioning status.
Figure 6:
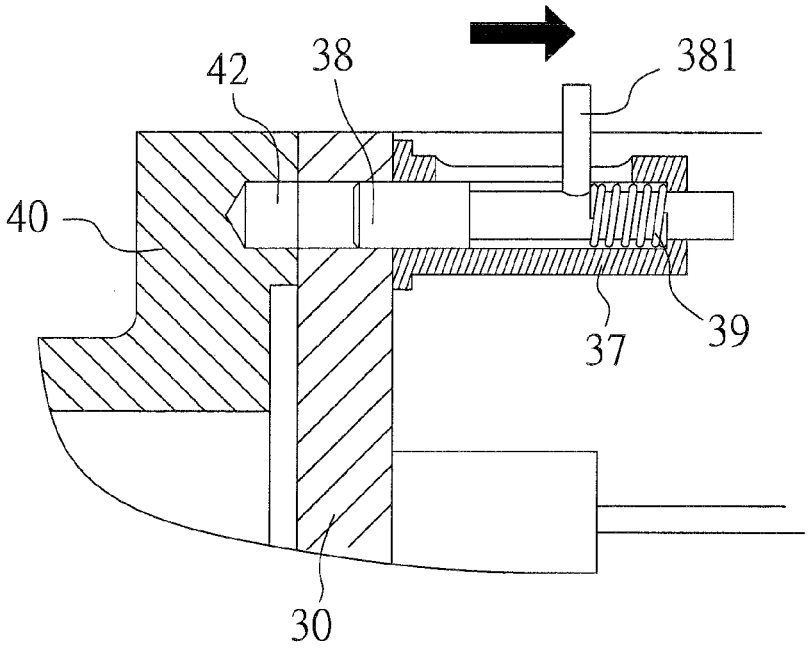
FIG. 6 is a schematic drawing of a preferred embodiment of the invention illustrating the structure relation between the elastic lockpin and the tool holder.
Figure 7:
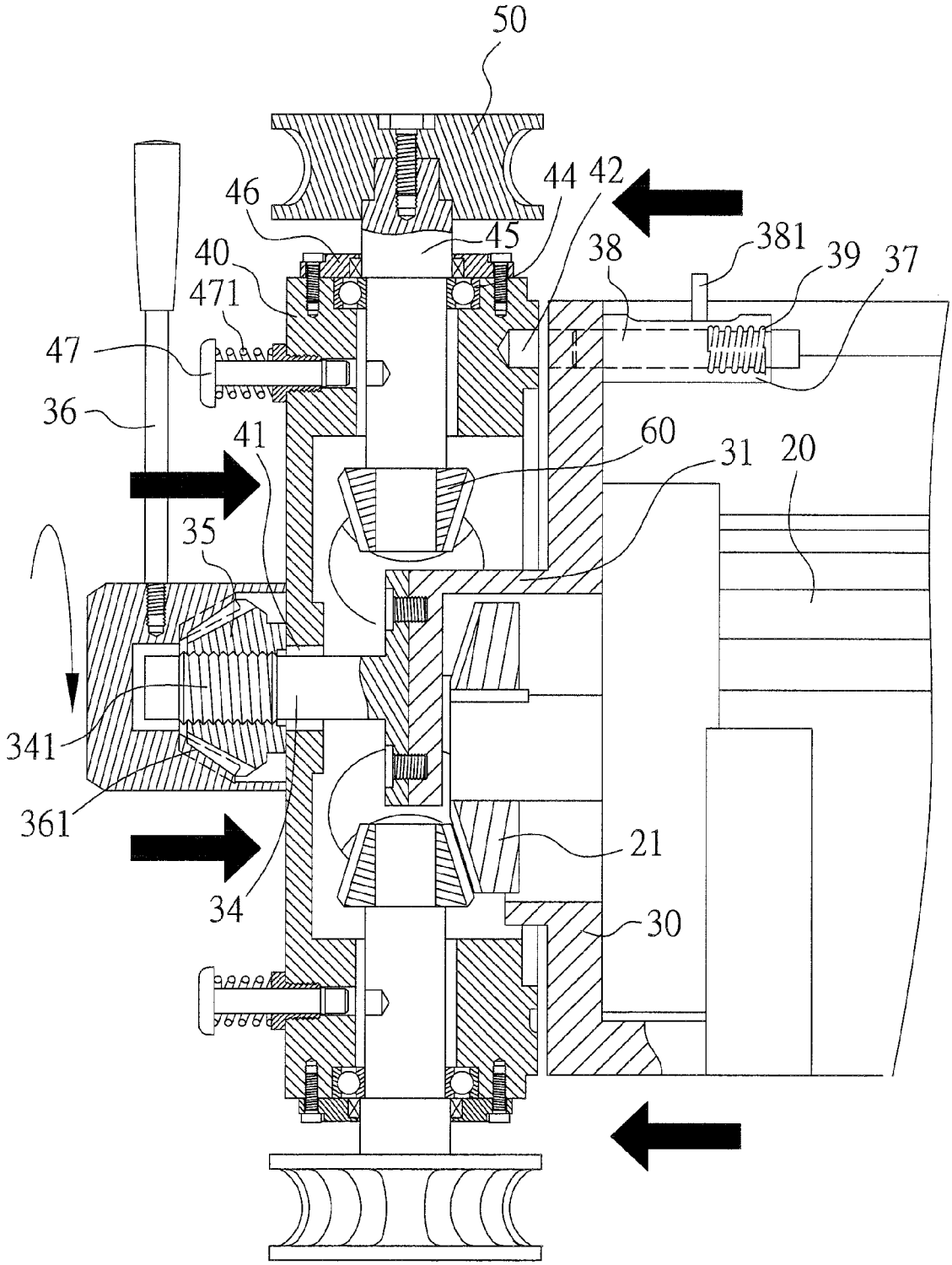
FIG. 7 is schematic drawing of a preferred embodiment of the invention illustrating the structure relation of the push status imposed by the released limit ratchet wheel on the tool holder.

Through the schematic drawings and embodied examples, the structural composition, technical arts and achieved functions of the invention are further described below:

Please refer to the structural schematic drawing in FIG. 1, the partial explosion of structure explosion view in FIG. 2, and the structure relation schematic drawings in FIGS. 3~7 for a preferred embodiment of the invention;

As illustrated in the drawing, the structure design of the stone chamfering machine of the invention is mainly comprised of a frame 10, inside which a transmission motor 20 is installed. A transmission gear 21 is installed on the spindle of the transmission motor 20, whereof the transmission gear 21 has one end exposed outside through side plate 30 of the frame 10 and forms a motion linkage by engaging with the driven gear 60 of tool 50 installed on the tool holder 40 which is guarded by the side plate 30, whereby the tool 50 is driven by the transmission motor 20 to do chamfering operation on the stones.

The bottom of the frame 10 is installed on a movable base 11, the base 11 is installed with a pair of support posts 12 at its two sides to assemble with the handle 13. Further, the support post 12 at one side of the base 11 is horizontally pierced through with a through hole to assemble with a tube connector 14 and a flexible water hose 15, wherein the water hose 15 is extended to the position of tool 50 for spraying water to the operating zone of tool 50 in order to reduce the surrounding temperature and to avoid dusting, and thereby to constitute the basic functioning structure of the stone chamfering machine of the invention.

The transmission motor 20 inside the frame 10 is installed with a downward offset so as to provide an eccentric relationship between the transmission gear 21 of the transmission motor 20 and the convex block 31 installed on the side plate 30 at one end of the frame 10, whereof the bottom of the convex block 31 is provided with a cut slot 32 which is extended in a concave arc 33 to the two ends to allow the transmission gear 21 of the transmission motor 20 to appear partially exposed, and a screwed bolt 34 is installed at one end of the convex block 31 on the side plate 30, whereof the screwed bolt 34 is pierced through the centered through hole 41 of tool holder 40 which encloses the side plate 30. The middle screwed section 341 of the screwed bolt 34 is installed with a limit ratchet wheel 35 which is engaged with and driven by the limit ratchet gear 361 which is installed inside the compacting plate handle 36, whereby to lock the limit ratchet wheel 35 and the screwed bolt 34 together, whereby to push the tool holder 40, frame 10 and side plate 30 into a complete matching relationship. Simultaneously, a pin seat is provided at a preset place on the side plate 30 to assemble with an elastic lockpin 38 which is pushed by spring 39 inside the pin seat 37 to protrude into the end face of the side plate 30, wherein through the several preset positioning holes 42 provided at the inside face of the tool holder 40, the elastic lockpin 38 is able to limit the related relationship between the tool holder 40, frame 10 and side plate 30 by lock inserting into any one of the positioning holes 42 of the tool holder 40 and restrain the tool holder 40 from rotation unless the elastic lockpin 38 is retreated out of the positioning hole 42 of the tool holder 40 by pulling the attached pull rod 381 of the elastic lockpin 38, and through reversely rotating the limit ratchet wheel 35 by the compacting plate handle 36 to lessen the compression on tool holder 40 so that the screwed bolt 34 which installed on the convex block 31 of the side plate can be properly rotated to change position.

The tools 50 are installed on the tool holder 40 in multi-angle and multi-axis embodiment, whereof the tool holder 40 is made to a polygon shell and is provided with a shaft hole 43 individually at its respective sides to install with bearing 44 and spindle 45, whereby it is sealed by the bearing cover 46 which is locked from outside. The inner end of spindle 45 is installed with the driven gear 60 while the outer end of spindle 45 is installed with the tool 50 so that each side of the tool holder 40 is respectively installed with tools 50 in different specifications, whereof each tool 50 has its own independent driven gear 60 to offer smooth change operation (such as: new tool replacement) for the tool 50 and spindle 45 if necessary. Further, one elastic positioning pin 47 is respectively installed at a position corresponding to each spindle 45 on the tool holder 40, whereof each spindle 45 is provided with at least one positioning cavity 451 to let elastic positioning pin 47 lock into it so as to prohibit spindle 45 from turning whereby to provide easy mounting/dismounting of tool 50, whereof the spring 471 which sleeves the elastic positioning pin 47 can push back elastic positioning pin 47 after disappearance of pressing force and release spindle 45 back to its original rotating status.

As such, by employing the above disclosed structure assembling design, through the same axis installation of tool holder 40, frame 10 and side plate 30 and the downward offset of transmission motor 20 on the frame 10, the transmission gear 21 of the transmission motor 20 is able to pierce through the cut slot 32 of the center convex block 31 on the side plate 30 of frame 10 and to reach a driving engagement relationship with the driven gear 60 of bottom tool 50 on the tool holder 40, whereby to perform stone chamfering operation through rotating the bottom tool 50 on the tool holder 40, and in case that tool 50 of different specification is required, the operator only has to turn the compacting plate handle 36 reversely to engage with and drive the limit ratchet gear 35 to release the compressing status on the tool holder 40, and further to retreat the elastic lockpin 38 located at one side of the side plate 30 to release the locking relationship with the tool holder 40, then the tool holder 40 along with its installed tools 50 can be properly rotated with the screwed bolt 34 of the convex block 31 on the side plate as the axis, whereby to rotate the tool 50 to the bottom position of tool holder 40 and to release the elastic lockpin 38 which is pushed by its internal spring 39 to recover it back to the original locking position with tool holder 40. In the last step, the compacting plate handle is operated to engage and drive the limit ratchet wheel 35 to compress the tool holder 40, frame 10 and side plate 30 to a complete match; thereby to achieve a perfect engaging relationship between the driven gear 60 of the tool 50 and the transmission gear 21 of the transmission motor 20 so as to recover the operating status of the stone chamfering machine. Therefore, it is particularly useful to provide a tool 50 direct change function for the stone chamfering machine; i.e. as the above description has shown, the structure design of the stone chamfering machine of the invention is through the multi-axis tools at different angles on the tool holder and its offset transmission motor to obtain the transmission embodiment so that when in facing different demands of stone chamfering operation, a suitable tool can be selected by directly rotating the tool holder, thus avoiding troubles and inconveniencies in repeatedly mounting/dismounting tools in the conventional structures thereby to significantly reduce the replacement man hour costs and through the design allowing tools of different specifications to be prepared at the same time, additional tool storage boxes for carry and storage are no longer required, so the tool lost problem is unlikely to happen. In general, it can really solve the existing and derived problems of the conventional one-tool stone chamfering machines to greatly promote its applicability values and usefulness to the industry.

As summarized from the above descriptions, the tool holder transmission structure of the stone chamfering machine of the invention is through the design of multi-axis tools on the tool holder and the transmission of offset motor to achieve normal stone chamfering function while the suitable tool selection and replacement can be rapidly completed by rotating the tool holder in facing different operation requirements, thus avoiding too much man hours spending on the tool replacement and the numerous troubles and inconveniencies to purchase additional multiple tools for carry and storage separately. In general, it is an excellent and outstanding innovated design which has very good application and useful values to the industry. Therefore, the lawfully patent application is intended.

The invention claimed is:

1. A tool holder transmission structure of a stone chamfering machine, comprising:

a handle;

a plurality of tool assemblies, each having a spindle, a driven gear attached to an inner end of the spindle, a tool attached to an outer end of the spindle, a bearing and a bearing cover;

a compacting handle having a limit ratchet gear installed therein;

a limit ratchet wheel which is engaged with and driven by the limit ratchet gear;

a tool holder having a centered through hole, and having the tool assemblies installed thereon, an inside face of the tool holder having a plurality of preset positioning holes, the tool holder being a polygonal shell and having a shaft hole disposed at each respective side, each shaft hole having a respective spindle and bearing therein, each shaft hole being sealed at an outside thereof by a respective bearing cover;

a flexible water hose that is extendable to a position of a respective tool for spraying water to an operating zone of the tool in order to reduce a surrounding temperature and to avoid dusting;

a frame having a side plate that guards the driven gears, the side plate being covered by said tool holder, the side plate having a pin seat;

an elastic lockpin which is pushed by a spring inside the pin seat to protrude past an end face of the side plate, the elastic lockpin having a pull rod;

a transmission motor installed inside of said frame, and having a spindle, the respective tool being driven by the transmission motor to do a chamfering operation on stones, the transmission motor further having a transmission gear installed on the spindle, said transmission gear having one end exposed outside through said side plate of said frame to form a motion linkage by engaging with a respective driven gear of the respective tool;

a convex block installed on the side plate, a bottom of the convex block having a cut slot to allow the transmission gear to be partially exposed;

a movable base having a bottom of the frame installed thereon, the movable base having a pair of support posts at two sides thereof to connect with the handle, one of the support posts at one side of the movable base being horizontally pierced through with a through hole to connect with the flexible water hose;

wherein the transmission motor is installed with a downward offset so as to provide an eccentric relationship between the transmission gear and the convex block; and a screwed bolt installed at one end of the convex block, the screwed bolt passing through the centered through hole of the tool holder, a middle screwed section of the screwed bolt being engaged with the limit ratchet wheel, wherein when the compacting plate handle is rotated, the limit ratchet gear causes the limit ratchet wheel to turn on the middle screwed section to push the tool holder, frame and side plate into a complete matching relationship, the elastic lockpin being engagable with a respective positioning hole when the holder, frame and side plate are in the matching relationship to restrain the tool holder from rotation, the elastic lockpin being retreatable out of the positioning hole of the tool holder by pulling the pull rod, and the limit ratchet wheel being reversely rotatable by the compacting plate handle to lessen a compression on the tool holder to allow the tool holder to be rotated to change its position.

2. The tool holder transmission structure of the stone chamfering machine as in claim 1, further comprising a plurality of elastic positioning pins and spring pairs, each elastic positioning pin and spring pair being respectively installed at a position corresponding to each spindle on the tool holder, each spindle being provided with at least one positioning cavity to let the respective elastic positioning pin lock into it so as to prevent the spindle from turning thereby providing easy mounting/dismounting of the tool, the spring of each pair being sleeved over the respective elastic positioning pin to push back the elastic positioning pin after a pressing force is removed to release the spindle back to its original rotating status.

3. The tool holder transmission structure of the stone chamfering machine as in claim 1, whereof the cut slot is extended in a concave arc between its two ends.

* * * * *